United States Patent [19]

Fales et al.

[11] Patent Number: 4,672,937

[45] Date of Patent: Jun. 16, 1987

[54] FUEL PUMP SYSTEM

[75] Inventors: Douglas I. Fales; Robert A. Roth, both of Flint, Mich.

[73] Assignee: General Motors Corporation, Detroit, Mich.

[21] Appl. No.: 864,600

[22] Filed: May 19, 1986

[51] Int. Cl.[4] ..... F02M 39/02

[52] U.S. Cl. ..... 123/509; 123/495; 123/514; 123/516; 417/40; 220/855; 137/263

[58] Field of Search ..... 123/198 D, 516, 514, 123/509, 510, 495; 417/40, 36, 35, 364, 368; 137/572, 576, 579, 263; 220/85 S, 113

[56] References Cited

U.S. PATENT DOCUMENTS

| | | | |
|---|---|---|---|
| 1,875,541 | 9/1932 | Claypool | 415/183 |
| 3,101,771 | 8/1963 | McCuen | 137/263 |
| 3,443,519 | 5/1969 | White | 417/366 |
| 4,175,507 | 11/1979 | Sanada | 123/514 |
| 4,189,096 | 6/1966 | Grunwald | 123/514 |
| 4,449,723 | 5/1984 | Shiratsulhi | 220/85 S |

FOREIGN PATENT DOCUMENTS

| | | | |
|---|---|---|---|
| 2261394 | 6/1973 | Fed. Rep. of Germany | 123/516 |
| 2844053 | 4/1980 | Fed. Rep. of Germany | 123/509 |
| 0062958 | 4/1982 | Japan | 123/509 |

*Primary Examiner*—Carl Stuart Miller

*Attorney, Agent, or Firm*—Saul Schwartz

[57] ABSTRACT

A fuel system for maintaining fuel flow when the surface of the pool of fuel in the fuel tank is below a minimum level. The fuel pump system includes a reservoir in the fuel tank and a pump in the reservoir. A motor in the pump drives a first pump which draws fuel from a secondary chamber of the pump and discharges it to the engine. The motor also drives a second pump which draws fuel from the tank through a primary chamber and discharges it to the secondary chamber. The excess of fuel discharged by the second pump over the first pump is discharged through an orifice in the pump to the reservoir. At fuel levels below the minimum, a float controlled solenoid closes an intake port to the primary chamber causing fuel to back-flow through the flow orifice to the secondary chamber to supply the first pump.

3 Claims, 4 Drawing Figures

FUEL PUMP SYSTEM

FIELD OF THE INVENTION

This invention relates generally to automotive fuel systems and, more particularly, to fuel pump systems for maintaining fuel flow when tank fuel level temporarily recedes below a predetermined minimum level.

DESCRIPTION OF THE PRIOR ART

Automotive fuel injectors require a constant supply of pressurized fuel from the fuel pump. Consequently, fuel pump intakes are usually located very low in the tank with baffles provided to minimize the likelihood that the intake will be exposed during cornering or other vehicle maneuvers which tend to displace fuel in the tank. In a more elaborate, prior system, a reservoir is provided within the fuel tank and a submerged fuel pump is disposed in the reservoir. The fuel pump has an electric motor which drives the impeller of one pump which draws from the tank and discharges directly into the reservoir at one flow rate. The motor simultaneously drives another pump which draws only from the reservoir and discharges fuel to the fuel injection system at a flow rate which is less than the flow rate of the one pump. The fuel injectors are thus continuously supplied with fuel as long as there is fuel in the reservoir regardless of whether or not the intake of the one pump is submerged. A fuel system according to this invention is a new and improved alternative to the prior system just described.

Summary of the Invention

The fuel pump system according to this invention is a new and improved reservoir-type system wherein a fuel pump submerged in an in-tank reservoir includes one pump which normally draws fuel from the main tank through a primary chamber and discharges the fuel at one flow rate to a secondary chamber and further includes another pump which draws fuel from the secondary chamber and discharges it to the fuel injectors at a flow rate less than the flow rate of the one pump, the excess fuel from the one pump being discharged from the secondary chamber into the reservoir to maintain the reservoir in a fuel-filled condition. The primary chamber has an intake port which is open when tank fuel level is above a predetermined minimum and is sealed by level responsive valving at lower fuel levels, the other pump thereupon creating a vacuum in the secondary chamber so that fuel back-flows from the reservoir into the secondary chamber. In a preferred embodiment of the fuel system according to this invention, the primary chamber is opened and closed by a solenoid operated valve responsive to tank fuel level and the one pump is an open vane regenerative pump which, in addition to supplying fuel to the secondary chamber, also separates vapor from the fuel so that the other pump is normally supplied with only vapor-free fuel.

DESCRIPTION OF THE DRAWINGS

Referring now to FIGS. 1 and 2 of the drawings, a fuel chamber 8 of an automobile fuel tank 10 is defined on top by an upper panel 14 of the tank and on the bottom by a lower panel 16 of the tank. The upper panel 14 has a circular aperture 18 therein, FIG. 2, through which a reservoir type fuel pump system 20 according to this invention is introduced into the fuel chamber 8 and whereat the fuel pump system is secured to the tank.

Figure 1:
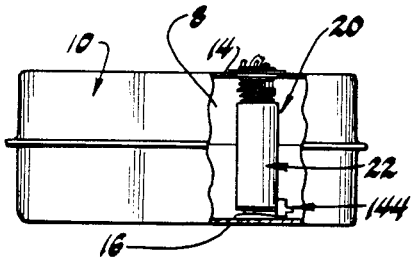
FIG. 1 is a schematic elevational view of an automobile fuel tank having a fuel pump system according to this invention disposed therein.
Figure 2:
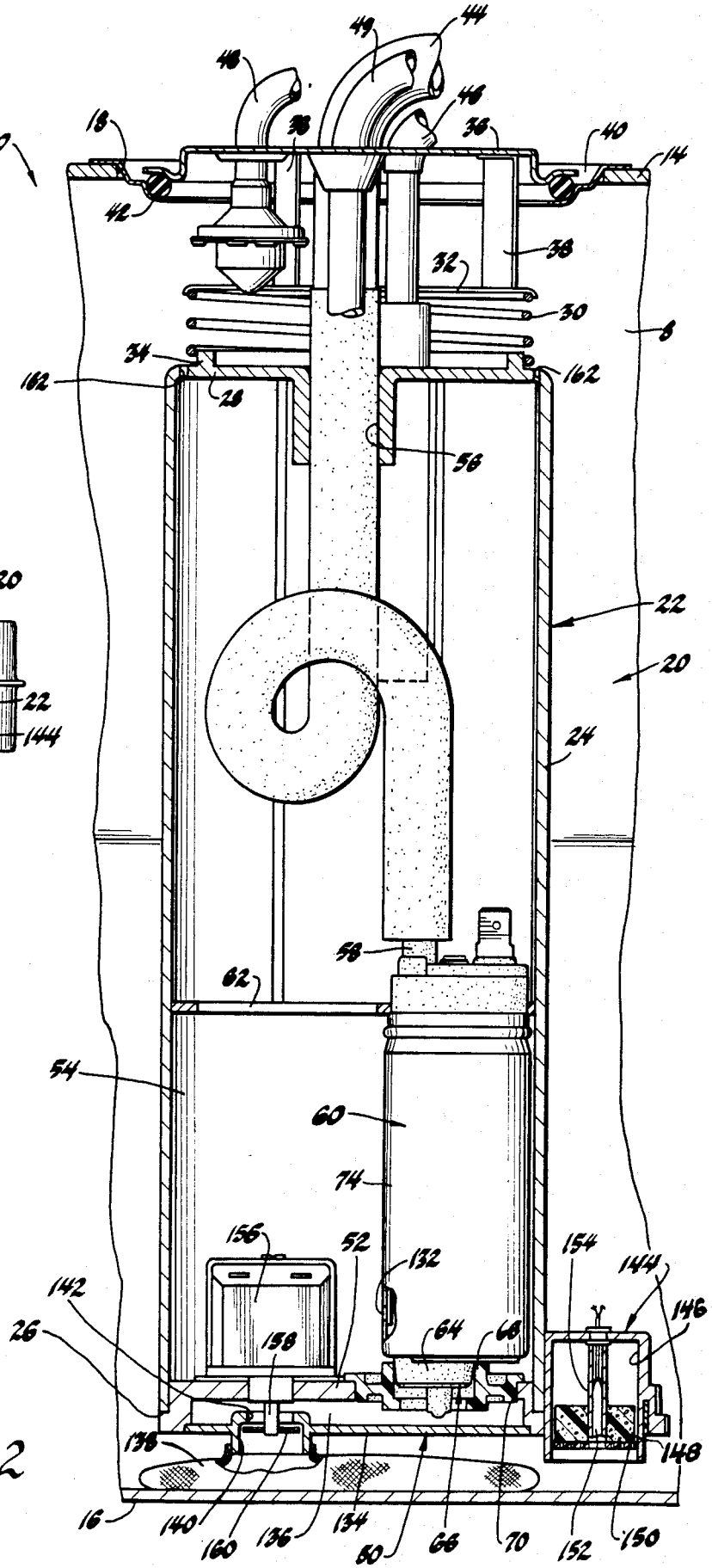
FIG. 2 is an enlarged view of a portion of FIG. 1 showing the fuel pump system according to this invention.

As seen best in FIG. 2, the fuel pump system 20 includes a reservoir housing 22. The housing 22 includes a cylindrical wall portion 24 which is open at a lower edge 26 and a circular upper end wall 28 integral with the cylindrical wall portion 24. A coil spring 30 bears at one end against a seat 32 and at the other end against the upper end wall 28 around a pilot flange 34 on the latter. The seat 32 is connected to a closure plate 36 through a plurality of posts 38. The peripheral edge of the closure plate 36 overlaps the radially innermost edge of an annular attaching plate 40 and is separated from the latter by an elastomeric ring 42. Fasteners, not shown, clamp the closure plate 36 to the attaching plate 40 and squeeze the ring 42 therebetween so that a vapor tight seal is defined between the closure and attaching plates. Additional fasteners, not shown, secure a radially outer portion of the attaching plate 40 to the upper panel 14 of the fuel tank.

A plurality of tubes traverse the closure plate 36 through appropriate vapor-tight grommets or gaskets, the tubes including a main fuel supply tube 44, a fuel return tube 46, a vapor purge tube 48 and an electrical conduit 49. The main fuel supply tube 44 is typically connected to the fuel injection system of the vehicle, not shown, to supply fuel to the latter. The fuel return tube 46 is typically connected to an appropriate overflow device in the fuel injection system and conducts excess fuel from the fuel injection system back to the tank 10. The vapor purge tube 48 is typically connected to a charcoal canister or like device which captures fuel vapors when the vehicle is parked. The electrical conduit 49 typically has conductors therein for energizing the motor of the fuel pump system.

Figure 3:
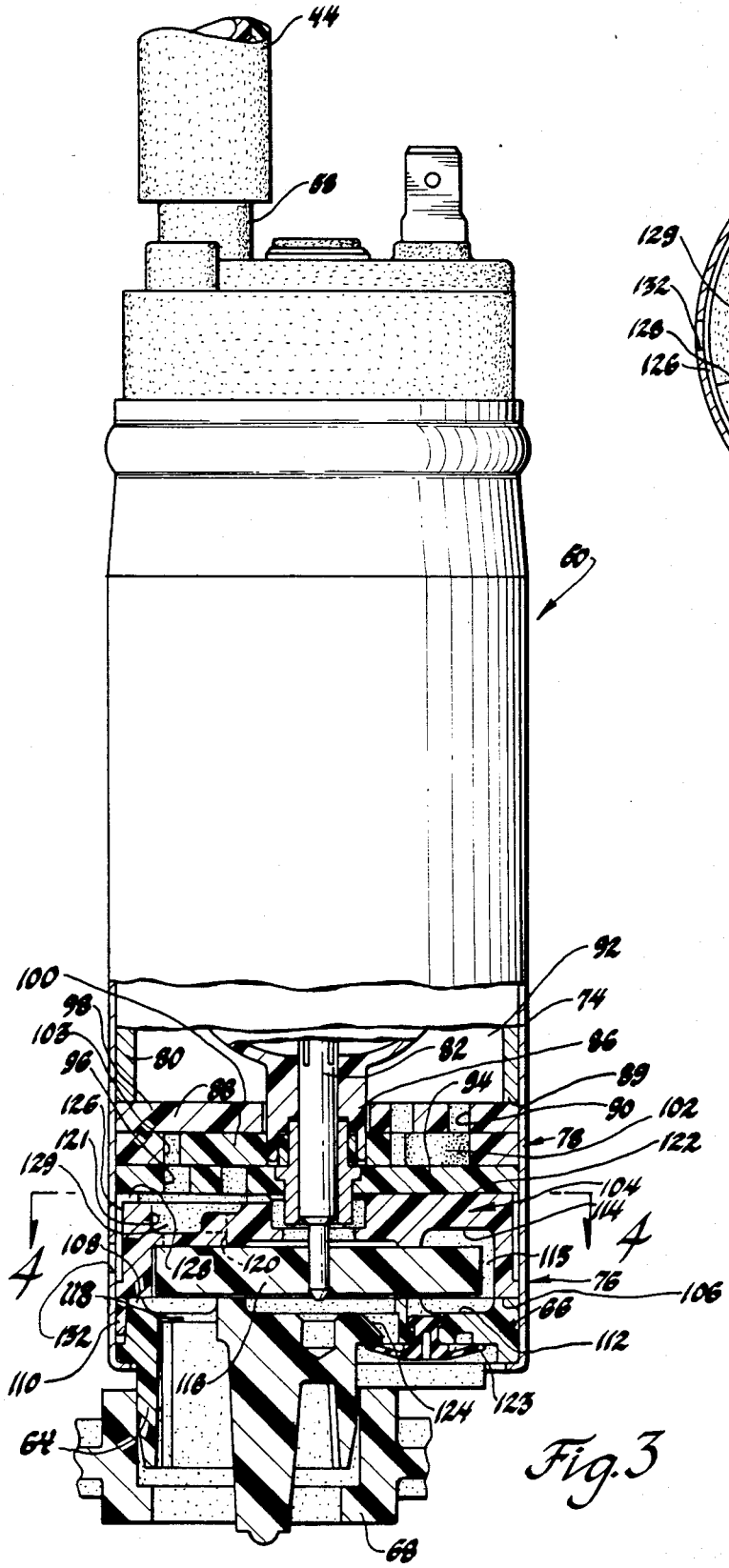
FIG. 3 is an enlarged, partially broken away view of a portion of FIG. 2.

With continued reference to FIG. 2, an end assembly 50 of the fuel pump system 20 includes a circular wall 52 which closes the lower end of the cylindrical wall portion 24. The circular wall 52 cooperates with the upper end wall 28 and the cylindrical wall portion 24 in defining a reservoir chamber 54 within the tank fuel chamber 8. Inboard of the closure plate 36, the main fuel supply tube 44 extends into the reservoir chamber 54 through a flanged aperture 56 in the upper end wall 28. The inner end of the fuel return tube 46, not shown, likewise extends into the reservoir chamber 54. The inner end of the fuel supply tube 44 is connected to an appropriate fuel discharge nipple 58 on an electric fuel pump 60. A perforated partition 62 in the reservoir chamber 54 supports the upper end of the fuel pump 60 and maintains the latter in a vertical orientation. At the lower end of the fuel pump, a cylindrical flange 64 on an inlet body 66 of the pump, FIG. 3, is connected to the circular wall 52 through a cushioning bushing 68 in an aperture 70 in the wall. The bushing 68, in addition to supporting the lower end of the pump 60, isolates the latter from the reservoir housing 22 for vibration and noise control. Appropriate electrical conductors in the conduit 49 are connected to appropriate terminals on the fuel pump 60, not shown, whereby operation of the fuel pump is synchronized with the state of the ignition system of the vehicle.

Figure 4:
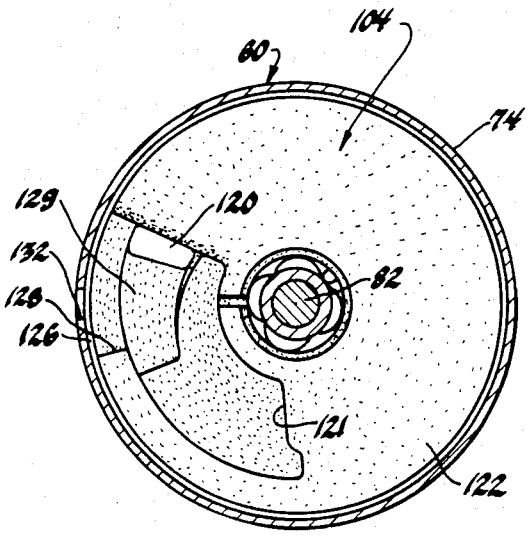
FIG. 4 is a sectional view taken generally along the plane indicated by lines 4—4 in FIG. 3.

Referring particularly to FIGS. 2, 3, and 4, the fuel pump 60, except as otherwise indicated, is generally conventional and includes a tubular, cylindrical housing 74 in which are disposed a low-pressure regenerative pump 76, a high-pressure, positive displacement, roller vane pump 78, and an electric motor, not fully illustrated, for simultaneously driving both the regenerative pump and the roller vane pump. The electric motor includes a cylindrical flux ring 80 within the housing 74 and an armature shaft portion 82. The shaft portion 82 is rotatable about a longitudinal axis of the pump as a unit with a drivefork 86.

The roller vane pump 78 includes a circular discharge plate 88 abutting an edge 89 of flux ring 80. The discharge plate 88 has a discharge port 90 opening into an internal volume 92 of the housing 74 around the armature shaft portion. The roller vane pump 78 further includes a circular inlet plate 94 having an inlet port 96 therein and a pump ring 98 captured between the discharge plate 88 and the inlet plate 94. The two plates and the ring are rigidly interconnected by axially extending fasteners, not shown. An eccentric rotor 100 of the vane pump is disposed within the pump ring 98 and is drivingly connected to the drivefork 86. A plurality of cylindrical rollers 102 are carried in appropriate pockets of the eccentric rotor 100 and ride against an inner surface 103 of the pump ring 98 when the rotor is rotated by the motor through the drive fork. The spaces between the rollers 102 define variable volume chambers which operate to pump fuel from the inlet port 96 to the discharge port 90 when the rotor rotates. At a normal operating speed of the motor, the roller vane pump provides fuel at a first predetermined fuel flow rate at the discharge port 90 sufficient to meet all of the fuel requirements of the fuel injection system.

Referring to FIGS. 3 and 4, the low pressure pump 76 includes, in addition to the inlet body 66, a generally cylindrical discharge body 104 disposed between the inlet body 66 and the inlet plate 94 of the roller vane pump 78. An end surface 106 of the discharge body 104 is disposed in a plane perpendicular to the axis of rotation of the shaft portion 82 and abuts a corresponding end surface 108 on the inlet body 66. A key 110 integral with the discharge body 104 extends into an appropriate notch in the inlet body 66 whereby relative rotation between the inlet and discharge bodies is prevented. A shallow annular groove 112 in the inlet body 66 is aligned with a deeper annular groove 114 in the discharge body 104 and cooperates with the latter in defining an annular pumping chamber 115 around the peripheral edge of an open vane, regenerative pump impeller 116. The impeller is loosely captured between the inlet and discharge bodies and is drivingly connected to the distal end of armature shaft portion 82.

An inlet port 118 in the inlet body 66 provides communication between the interior of the annular flange 64 on the inlet body and the pumping chamber 115. A discharge port 120 in the discharge body 104 defines a channel between the pumping chamber 115 and a cavity 121 in an end wall 122 of the discharge body. The cavity faces and is closed by the inlet plate 94 of the roller vane pump and overlies the inlet port 96 to the latter. Appropriate stripper walls, not shown, on the inlet and discharge bodies 66 and 104 operate in conventional fashion to prevent leakage of fuel from the discharge port back to the inlet port 118 of the low pressure pump. A flapper valve 123 on the inlet body 66 loosely seals a vapor discharge port 124 and permits escape of vapors from the pumping chamber 115 while preventing both vapor and liquid back-flow in the opposite direction. Vapors separate in the pump 76 as the impeller 116 rotates because the liquid fuel, being heavier than the vapors, is propelled radially out and forces the vapors in the opposite direction toward the vapor discharge 124. At the normal rotating speed of the motor, the low pressure pump 76 provides-vapor-free fuel to the cavity 121 at a second fuel flow rate which exceeds the first fuel flow rate of the roller vane pump so that when the motor is on, the pump 76 always provides more fuel at the inlet port 96 than the roller vane pump 78 discharges.

As seen best in FIGS. 3 and 4, the pump 76 departs from heretofore known pump structures in that the outer cylindrical surface of the discharge body 104 has an external groove 126 therein which extends for less than the axial length of the cylindrical surface. When the discharge body is disposed within the tubular housing 74, the groove 126 cooperates with the housing in defining an annular chamber around the discharge body which communicates with the cavity 121 through a radial slot 128 in the end wall 122 of the discharge body. The cavity 121, the radial slot 128 and the annular groove 126 together form a secondary chamber 129 between the discharge port of the pump 76 and the inlet port 96 of the roller vane pump 78. A flow orifice 132 in the housing 74 provides communication between the secondary chamber 129 and the reservoir chamber 54.

Referring to FIGS. 2 and 3, the end assembly 50 has a circular cover 134 thereon which cooperates with the circular wall 52 in defining a primary chamber 136. A flexible screen 138 is attached to a flange 140 on the cover 134 and rests against the lower panel 16 of the fuel tank. An inlet port 142 in the cover 134 inside the flange 140 normally permits fuel to flow from the fuel chamber 8 in the tank, through the screen 138, and into the primary chamber 136. Fuel in the primary chamber 136 flows within the flange 64 of the inlet body 66 and into the inlet port 118 of the pump 76. The spring 30 bearing against the reservoir housing cooperates with the natural resilience of the screen 138 in supporting the fuel pump system 20 in the fuel chamber in the tank.

A float housing 144 integral with the end assembly 50 has an internal chamber 146 in which a float 148 is slidably disposed. A perforated retainer 150 at the lower end of the chamber 146 keeps the float 148 in the chamber but permits fuel to enter from below so that the float 148 can ride on the surface of the pool in the fuel chamber 8 when the surface of the pool is at the level of the float housing 144. A reed switch 152 is disposed within a center tube 154 of the housing 144 and is responsive to the position of the float 148. When the surface of the pool in the fuel chamber 8 exceeds a predetermined minimum level above the lower panel 16 the float 148 is above the retainer 150 and the switch 152 is open. When the surface of the pool recedes below the predetermined minimum level, the float 148 moves down toward the retainer 150 and closes the switch 152.

As seen best in FIG. 2, the switch 152 in the float housing 144 controls a solenoid 156 mounted on circular wall 52. The solenoid has a linearly shiftable armature 158 which extends down through the inlet port 142 to the primary chamber 146 and carries at its distal end a valve plate 160. When no current is supplied to the solenoid 156, i.e., when the solenoid is deenergized, the valve plate 160 is positioned by the armature 158 in an open position, FIG. 2, remote from the inlet port 142. When current is supplied to the solenoid 156 the armature 158 is withdrawn into the solenoid and positions the valve plate 160 in a closed position sealing the inlet port 142. Accordingly, with the reed switch 152 connected to a power source and to the solenoid, when the surface of the pool in the fuel chamber 8 of the tank exceeds the predetermined minimum level the switch 152 is open, the solenoid 156 is deenergized, and the port 142 is open. Conversely, when the surface of the pool is below the predetermined minimum level, the switch 152 is closed, the solenoid 156 is energized, and the valve plate 160 seals the inlet port 142.

The fuel pump system 20 operates as follows. As the fuel chamber 8 in the tank is filled from empty the surface of the pool therein rises from the lower panel 16. Normally, the ignition is off during the fueling process so that the solenoid 156 is deenergized and the inlet port 142 is open. Accordingly, the fuel rises up through the inlet port 142 and fills the primary chamber 136. Simultaneously, the float 148 moves upward until it engages the upper surface of the chamber 146 and is then submerged as fuel filling continues. When the ignition is turned on the motor in pump 60 is energized and drives both the eccentric rotor 100 of the roller vane pump 78 and the impeller 116 of the pump 76. Fuel is drawn from the primary chamber 136 by the pump 76 and discharged into the secondary chamber 129. Roller vane pump 78 draws fuel from the secondary chamber 129 and discharges it to the main fuel supply tube 44 for delivery to the fuel injection system of the vehicle. The excess of fuel delivered to the secondary chamber by the pump 76 over the amount drawn off by pump 78 is discharged into the reservoir chamber 54 through the flow orifice 132 to fill the chamber with fuel. Simultaneously, excess fuel not consumed at the engine of the vehicle pours into the reservoir chamber from return tube 46. A plurality of vents 162 in the upper end wall 28 permit air and vapor escape as the fuel fills the reservoir chamber and also permits any excess fuel in the reservoir chamber to escape into the fuel chamber 8.

As the quantity of fuel in the fuel chamber diminishes, the surface of the pool therein approaches the predetermined minimum level. If the vehicle experiences an extended cornering maneuver during which the fuel in the tank migrates to one side or the other the surface of the pool on which the float 148 rides may recede below the predetermined minimum value. At that instant, the reed switch 152 closes, the solenoid 156 is energized, and valve plate 160 is shifted to the closed position sealing the inlet 142. With the primary chamber 136 thus sealed, pump 76 no longer supplies fuel at the second fuel flow rate described above to the secondary chamber 129. However, because roller vane pump 78 continues to operate normally, a vacuum is created in the secondary chamber 129 and fuel is drawn in backflow fashion from the reservoir chamber 54, through the flow orifice 132, through the external groove 126 and the radial slot 128, and then into the inlet port 96 of the roller vane pump. The supply of fuel to the roller vane pump thus continues uninterrupted even though the inlet port 118 of the pump 76 is effectively blocked. At the end of the cornering maneuver, the surface of the pool in the fuel chamber 8 rises above the predetermined minimum level and the reed switch 152 opens to deenergize the solenoid 156. The valve plate then shifts to the open position and pump 76 resumes normal operation with fuel being supplied from the primary chamber 136 and the excess being directed to the reservoir chamber through the flow orifice 132 to replenish the amount drawn off during the period when the valve plate 160 was in the closed position.

While the fluid level responsive means for opening and closing the primary chamber 136 of the preferred embodiment include the switch 152 and the electrically operated solenoid 156, other arrangements are possible. For example, the switch and solenoid of the preferred embodiment could be replaced by a mechanical float system, not shown, wherein a float on the surface of the pool in the chamber 8 closes and opens the inlet port to the primary chamber directly as the surface of the pool rises and falls relative to the predetermined minimum level.

The embodiments of the invention in which an exclusive property or privilege is claimed are defined as follows:

1. In a fuel pump system for an engine of an automotive vehicle having a fuel tank thereon defining a fuel chamber therein, said fuel pump system including a reservoir chamber within said fuel chamber, and a fuel pump in said reservoir chamber having an electric motor portion simultaneously driving at a normal operating speed of said motor portion a first pump having an intake port and a discharge port and a second pump having an intake port and a discharge port, said first pump at said normal operating speed of said motor portion providing a first fuel flow rate and said second pump at said normal operating speed of said motor portion providing a second fuel flow rate exceeding said first fuel flow rate, the combination comprising, means connecting said first pump discharge port to said engine, means on said fuel pump defining a secondary chamber, means connecting said first pump intake port to said secondary chamber and said second pump discharge port to said secondary chamber, means on said pump defining a flow orifice between said secondary chamber and said reservoir chamber operative to flow fuel in opposite directions between said secondary and said reservoir chambers, means in said fuel chamber defining a primary chamber having an intake port between said primary chamber and said fuel chamber, means connecting said primary chamber and said second pump intake port so that said second pump normally draws fuel from said fuel chamber through said primary chamber and discharges fuel to said secondary chamber, the excess of said second fuel flow rate of said second pump over said first fuel flow rate of said first pump being discharged through said flow orifice from said secondary chamber to said reservoir chamber, and means connected to said primary chamber responsive to the level of the surface of the pool of fuel in said fuel chamber operative to close said primary chamber intake port when the level of the pool surface is below a predetermined minimum level, said first pump thereupon creating a vacuum in said secondary chamber so that fuel back-flows through said flow orifice from said reservoir chamber to said secondary chamber to maintain a supply of fuel at said first pump intake port.

2. The combination recited in claim 1 wherein said second pump is an open vane regenerative pump having vapor separating means therein operative to separate vapors from fuel drawn from said primary chamber so that only essentially vapor-free fuel is delivered to said secondary chamber and to said first pump intake port.

3. The combination recited in claim 2 wherein said means connected to said primary chamber responsive to the level of the surface of the pool of fuel in said fuel chamber operative to close said primary chamber intake port when the level of the pool surface is below a predetermined minimal level includes, means in said fuel chamber defining a float housing exposed to the pool of fuel in said fuel chamber, a float in said float housing riding on the surface of the pool of fuel in said fuel chamber, a solenoid connected to said primary chamber having a linearly shiftable armature, a valve member connected to said solenoid armature and movable thereby between an open position remote from said primary chamber intake port and corresponding to a deenergized state of said solenoid and a closed position closing said intake port and corresponding to an energized state of said solenoid, and electrical switch means between a power source on said vehicle and said solenoid responsive to the position of said float, said float actuating said switch means to energize said solenoid when the surface of the pool of fuel in said fuel chamber is below said predetermined minimum level and to deenergize said solenoid when the surface of the pool of fuel in said fuel chamber is above said predetermined minimum level.

* * * * *